US005388655A

United States Patent [19]

Gruber

[11] Patent Number: 5,388,655

[45] Date of Patent: Feb. 14, 1995

[54] INJECTION BORING ANCHOR WITH AUGER BLADE

[76] Inventor: Heinz Gruber, Wilhelm-Busch-Strasse 2, 3370 Seesen/Rhüden, Germany

[21] Appl. No.: 965,215

[22] Filed: Oct. 23, 1992

[30] Foreign Application Priority Data

Nov. 9, 1991 [DE] Germany ..... 4136883

[51] Int. Cl.[6] ..... F21B 17/22

[52] U.S. Cl. ..... 175/323; 175/325.2; 175/394

[58] Field of Search ..... 175/320, 323, 325.2, 175/326, 394

[56] References Cited

U.S. PATENT DOCUMENTS

| | | | |
|---|---|---|---|
| 1,659,327 | 2/1928 | Montgomery | 175/323 |
| 1,846,177 | 2/1932 | Bascom et al. | 175/323 |
| 1,959,368 | 5/1934 | Kennedye . | |
| 2,088,759 | 8/1937 | Rassieur | 175/323 |
| 2,336,029 | 12/1943 | Ogarrio | 175/323 |
| 2,504,601 | 4/1950 | Spry . | |
| 2,831,659 | 4/1958 | Kukucheck et al. | 175/323 |
| 3,085,639 | 4/1963 | Fitch | 175/320 |
| 3,226,855 | 1/1966 | Smith | 175/323 |
| 3,301,338 | 1/1967 | Dickinson | 175/323 |
| 3,651,876 | 3/1972 | Henson | 175/323 |

FOREIGN PATENT DOCUMENTS

| | | |
|---|---|---|
| 0274719 | 7/1988 | European Pat. Off. . |
| 0355379 | 2/1990 | European Pat. Off. . |
| 0448397 | 9/1991 | European Pat. Off. . |
| 1083326 | 1/1955 | France . |
| 936082 | 7/1956 | Germany . |
| 2506611 | 8/1976 | Germany . |
| 3400182 | 1/1984 | Germany . |
| 3234406 | 3/1984 | Germany . |
| 3828335 | 8/1988 | Germany . |
| 9004176 | 8/1990 | Germany . |
| 4128154 | 6/1992 | Germany . |
| 790483 | 2/1958 | United Kingdom . |

*Primary Examiner*—Ramon S. Britts
*Assistant Examiner*—Frank S. Tsay
*Attorney, Agent, or Firm*—Michael J. Striker

[57] ABSTRACT

A boring tube has at least one tubular base body having a throughgoing longitudinal passage and an outer side and a coil arranged on the outer side of the base body and extending over its whole length. The coil has a pitch of 1 m–3 m and a radial width which starting from the outer side of the base body is at least 10 mm.

14 Claims, 3 Drawing Sheets

INJECTION BORING ANCHOR WITH AUGER BLADE

BACKGROUND OF THE INVENTION

The present invention relates generally to boring tubes.

In particular it relates to a boring tube which has at least one tubular base body with a longitudinal passage.

Boring tubes after producing a bore are used as a lost tool of the type of a rock anchor, and they are known in many forms. They must be suitable not only for producing a bore, but also for unobjectionable, particularly central guidance of the boring tube as well as for introduction of a mortar suspension or a similar, hardenable medium. The production of the bore requires the supply of a suitable rinsing medium which depends on the property of the surrounding rock or ground and is discharged in direction toward the bore opening during the boring progress. Due to the central guidance of the tube, in the hardened condition an all side uniform covering of the boring tube by the mortar suspension is obtained for protecting the boring tube from corrosive action. An introduction of the mortar suspension is conventionally performed through the boring tube located in the bore hole. The mortar is discharged preferably in the region of the boring crown and the bore hole is filled in a rearward direction, or in other words, in direction toward the bore hole mouth.

The central guidance of a boring tube with a spacer is disclosed in the non-published patent application P 41 28 154.3 of the applicant. The spacer is formed by several round iron members which are welded on the connecting sleeve provided for coupling of two boring tubes, and the length of the round iron members corresponds to the length of the respective collar.

SUMMARY OF THE INVENTION

Accordingly, it is an object of the present invention to provide a boring tube which insures in a simple manner, especially in cohesive ground, a central guidance of the boring tube and a reliable boring process.

In keeping with these objects and with others which will become apparent hereinafter, one feature of the present invention resides, briefly stated, in a boring tube in which a auger blade is arranged on an outer side of a base body and extends over the whole length of the base body, and the auger blade has a pitch of 1 m–3 m and a radial width, starting from the outer side of the base body, of at least 10 mm.

In accordance with the present invention, the base body is therefore provided at its outer side with a relatively steep auger blade which forms the boring tube, and the outer diameter of the auger blade corresponds to the radius of the bore hole. The auger blade performs several functions. It insures first of all that due to its steepness a relatively short flow path for a rinsing medium which carries ground particles is provided which in the cohesive ground as a rule is air, and also supports this transporting movement. Simultaneously, during the boring progress, the wall of the bore hole is held stable or smoothed over its whole length. Since the auger blade extends over the whole length of the boring tube, the boring tube further has a reliable support over its whole length against the walls of the bore hole and thereby is centrally guided in the bore hole. The central guidance guarantees that, in the case of the utilization of the boring tube formed as an injection tube or an injection bore anchor with an introduction of mortar or a similar hardenable medium in the bore hole, a simultaneous all-sided covering of the bore hole and thereby a reliable corrosion protection are provided. From the point of view of corrosion protection, the radial width of the auger blade amounts to at least 10 mm, preferably at least 15 mm.

The base body which forms the boring tube can be formed of one piece with the auger blade and composed of a cold deformed steel. The base body in the simplest case can therefore be a boring tube which is smooth in the outer surface region and is provided with a steep auger blade, while the auger blade in addition to the above described functions additionally can perform the function of an anchoring means inside the mortar.

In accordance with another feature of the present invention, the auger blade, in deviation from the one piece construction of the base body, can be formed as a separate part which is suitably connected with the base body for example by welding. It is important that the auger blade surfaces as seen in a cross-section of the base body are arranged tangentially to the contour of the base body, so that the surfaces of the base body and the auger blade which serve for the flow guidance are substantially uniform. This guarantees an unobjectionable transportation of the rinsing medium loaded with the dissolved ground particles and serves for a reliable embedding of the base body in the mortar suspension supplied into the bore hole. The auger blade can be formed as a hollow body, and alternatively can have a solid cross-section. In the first case it is open at its end side. This means that the inner space of the auger blade is also available for a transportation process and moreover is filled during introduction of the mortar.

In accordance with a further feature of the present invention, the auger blade can have a radially outwardly reducing profile in a cross-section. In the simple case it is a rectangular profile. Its both auger blade surfaces as seen in a cross-section of the base body, are arranged tangentially to the base body.

In accordance with a still further feature of the present invention, the base body is formed as a tubular body having inner and outer thread-like formations and the thread is formed as a thread which is useable for screwing the boring rods with one another. During hardening of the base body, an improved form-locking connection with the mortar is provided by the thread-like formations. Since the thread extends over the whole length of the base body, the base body can be cut when needed without influencing the action of the thread-like profile for screwing the boring rods with one another.

A still further feature of the present invention deals with a coupling piece which is used for screwing both boring tubes or base bodies. It is important that in the screwed condition the both boring tubes have the same radial dimensions, especially in the connecting region, so that the connecting region has no radially outwardly projecting structures, such as for example in the case of a sleeve used for screwing of boring tube ends. For this action it is important that the above mentioned second tube cylinder corresponds in its radial dimensions to the base body. The last tubular cylinder can when needed also be secured in its central position by point welding.

In accordance with a further feature of the present invention, in the screwed condition of two base bodies with the use of the inventive coupling piece, the flow which escapes from the end side of the open auger blade of one boring tube enters directly the open auger blade of the subsequent base body. This is obtained in that the screwing of the coupling piece with the base bodies, for example over the screw length, is formed so that both auger blade in the final screwed condition in which the base body abuts at the end against the above mentioned second tube cylinder are located exactly opposite to one another.

In a different embodiment of the coupling piece, the second tube cylinder is also provided with a auger blade which corresponds to the auger blade of the base body and in an assembled condition is connected with the latter auger blade. This means that the auger blade in accordance with the present invention, starting from the bore hole mouth to the bore hole bottom, extends over the connecting region of respective two base bodies with a continuously extending auger blade.

The boring tube can be provided with a releasable boring head which can be screwed with the boring tube. The boring head has a special supporting cylinder which extends over the length of the above mentioned coupling body and limits a ring chamber communicating with the central longitudinal opening of the boring head through radially extending openings. This means that during the boring, the rinsing medium on the one hand is discharged from the rinsing openings of the boring crown and simultaneously through the above mentioned radial openings of the coupling body and flows through the ring chamber in a rearward direction and generates at the end of the coupling body a suction which supports the withdrawal of the material removed during the boring progress. Simultaneously, a stabilizing and forming action is obtained due to the supporting cylinder for the surrounding bore hole walls. The supporting cylinder has an outer diameter which corresponds at most to the outer diameter of the boring crown, and preferably is insignificantly smaller than the latter.

The supporting cylinder is preferably non-releasably connected with the boring crown and can be welded with it. In accordance with a further feature of the present invention, it has smooth walls. Moreover, the position of the supporting cylinder is stabilized by webs which are fixedly connected with the coupling body.

The coupling body in accordance with a further feature of the present invention is formed so that it determines a threaded portion extending from it for screwing in the base body of a boring tube.

In accordance with still a further feature of the present invention, the coupling body utilizes only such elements which are used in the coupling part as well as in the base body. They are essentially two tubular cylinders of different length which are screwed in one another, and the inner cylinder forms a longer threaded portion extending outwardly of the outer cylinder for screwing in the associated end of a boring tube. Both tubular cylinders screwed in one another are welded at one end with the boring crown.

Finally, the inventive boring and injection tube can be designed so that the radial outer dimensions of the auger blade are slightly greater than the radial outer dimensions of the boring head, especially the boring crown. Preferably, the dimensions of the auger blade correspond to the dimensions of the supporting cylinder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a side view showing a blank bar of the inventive boring anchor with associated part; and FIG. 6 is a view showing a cross-section of the boring bar of FIG. 5.

DESCRIPTION OF THE PREFERRED EMBODIMENTS

Figure 1:
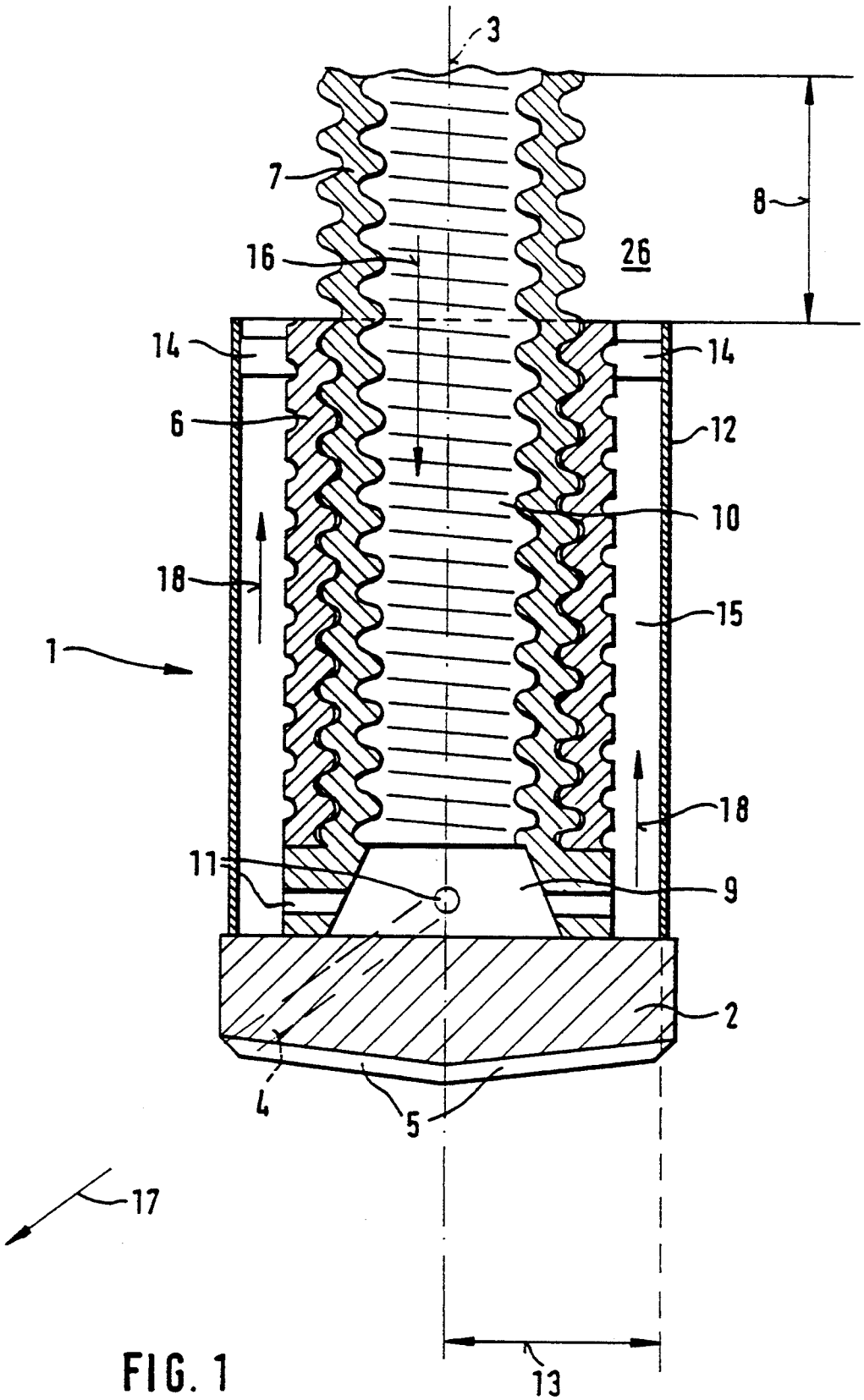
FIG. 1 is a view showing a boring crown injection boring anchor in accordance with the present invention.

A boring crown of a boring tube in accordance with the present invention is shown in FIG. 1 and identified as a whole with reference numeral 1. It is provided with an axially short, plate-shaped boring crown or core bit 2 which has at least one opening 4 shown in broken lines in FIG. 1 and having an axis intersecting a longitudinal axis 3 of the boring head or at least arranged off center of the axis 3. The opening 4 performs the function of a rinsing opening. The boring crown 2 is provided in a known manner with cutting edges 5 or similar means which extend at an outer side or at a side of the bore hole bottom.

A tube cylinder is identified with reference numeral 6. It has radial dimensions as well as wall thickness which corresponds to the boring parts to be described. A further tubular cylinder 7 is inserted in the tubular cylinder 6. Both tubular cylinders 6, 7 are composed of a cold rolled steel and provided with an inner thread and an outer thread, so that the tubular cylinder 7 having a smaller radius is screwed in the tubular cylinder 6. The tubular cylinder 7 extends outwardly from the tubular cylinder 6 by a length 8 and serves for coupling with a boring bar.

The system of the tubular cylinders 6 and 7 which are screwed in one another is welded with the boring crown 2 coaxially relative to the longitudinal axis 3. A hollow chamber 9 is rotation symmetrical relative to the longitudinal axis 3. It is directly connected with a longitudinal opening 10 of the tubular cylinder 7-and conically expand in direction toward the boring crown 2.

The hollow chamber 9 is provided with several radially extending openings 11 which pass through the walls of the tubular cylinders 6 and 7 screwed with one another.

The boring crown 2 extends radially beyond the system of the tubular cylinders 6, 7. It is connected with a smooth walled metal cylinder 12 which is also welded with the boring crown 2 and has a radial dimension 13 substantially corresponding to the radial dimension of the boring crown 2. The cylinder 12 extends in an axial direction over the length corresponding to the outer tubular cylinder 6 and is connected with the latter by webs 14. The webs are provided in the end region of the tubular cylinder 6 which is opposite to the boring crown 2. A ring chamber 15 is retained between the outer side of the tubular cylinder 6 and the inner side of the cylinder 12, and the above openings 11 open into the ring chamber 15. The cylinder 12 forms a supporting cylinder.

A rinsing medium for a mortar suspension flows in direction of the arrow 16 on the one hand through the opening 4 in direction of the arrow 17, and simultaneously through the openings 11 and the ring chamber 15 in direction of the arrow 18.

Figure 2:
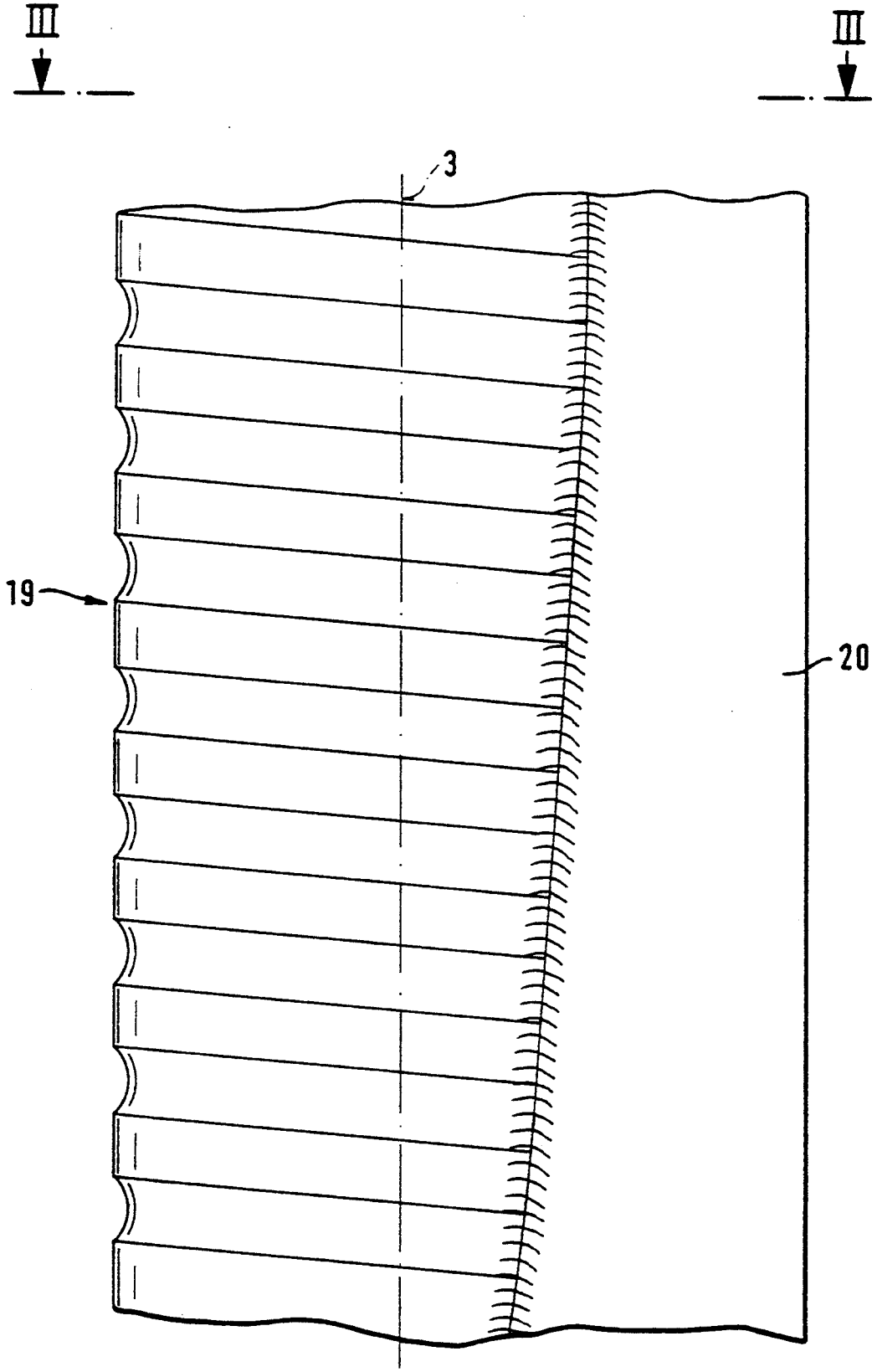
FIG. 2 is a view showing a part of a boring and anchoring rod of the injection boring anchor of the present invention.
Figure 3:
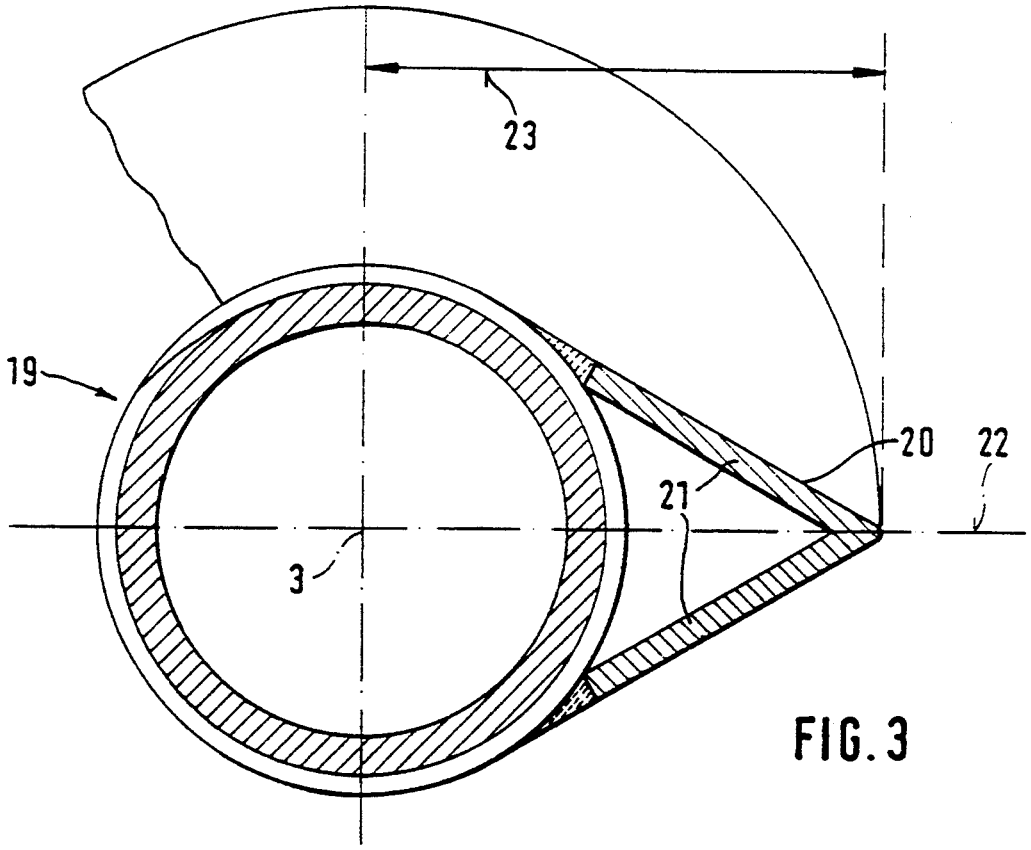
FIG. 3 is a view of the anchor rod corresponding to a plane III—III in FIG. 2.

A boring bar 19 shown in FIGS. 2 and 3 is formed as a tubular base body having a continuous outer thread and inner thread and composed of cold rolled steel. It has radial dimensions corresponding to the radial dimensions of the tubular cylinder 6. The inner thread of the boring bar 19 for screwing on the portion of the tubular cylinder 7 extending outwardly beyond the tubular cylinder 6 is determined so that in mounted condition of the boring bar the end of the tubular cylinder 6 abuts directly against the end of the boring bar 19.

Reference numeral 20 identifies a auger blade which in cross-section is formed by a substantially triangular hollow profile. The profile is defined by two substantially identical legs 21. The legs extend symmetrically relative to an axial plane 22 and substantially tangential to the cross-sectional contour of the boring bar. The legs 21 are welded to the boring bar.

The auger blade has a relatively great pitch of 1 m–3 m and is smooth at its outer side. The auger blade 20 extends uniformly over the whole length of the boring bar. The ends of the auger blade 20 are open and available for a throughflow. Practically, the auger blade 20 can be produced from a bent plate of the same material with the boring bar 19.

It is important that the radius 23 of the auger blade 20 substantially corresponds to the radius of the boring crown 22 and thereby to the radius of a bore hole. In some cases, the diameter of the auger blade can be greater than the diameter of the boring head and in particular by a value at most 1.05 times the diameter of the boring crown. The outer diameter of the boring bar 19 can be for example 15 mm–20 mm.

The purpose of the auger blade 20 will be explained in detail hereinbelow.

Figure 4:
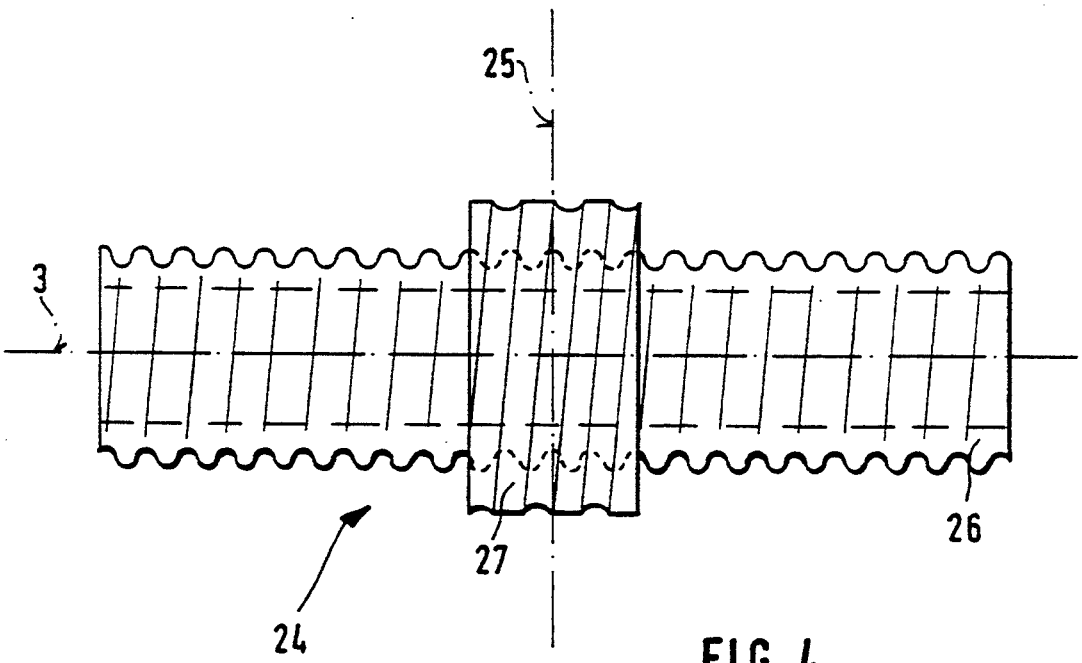
FIG. 4 is a view of a coupling part which is used for extending the anchoring rod of FIG. 2.

Reference numeral 24 identifies a coupling piece as a whole shown in FIG. 4. It is formed symmetrically relative to a radial plane 25. The coupling piece includes a first tubular cylinder 26 which has radial dimensions including its inner and outer threads corresponding to the radial dimensions of the tubular cylinder 7 of the boring head 1, and a second tubular cylinder 27 which corresponds with its inner and outer thread and the wall thickness to the tubular cylinder 6. The tubular cylinder 27 is screwed on the tubular cylinder 26 and fixed in a central position for example by point welding. The ends of the inner tubular cylinder 26 extend symmetrically at both sides of the tubular cylinder 27.

For mounting an extension boring bar of the type shown in FIG. 2, the coupling piece 24 is first screwed into the end of a boring bar and then the extension boring bar is screwed on the remaining tubular cylinder portion 26. In the mounted condition or in other words after screwing of the boring head 1 with a boring bar, a coupling piece 24 and an extension boring bar, the boring bar over its whole length has radially constant dimensions and there are no outwardly extending sleeve-like structures projecting in the connecting region of both boring parts. The boring parts are provided simultaneously over their whole length with a throughgoing thread. In addition, a throughgoing suitable opening extending over the whole length and in the connecting region through the tubular cylinder 26 is available for guiding a rinsing medium or a mortar suspension.

A coupling piece of the type shown in FIG. 4 can serve for mounting an extension boring bar, and also for mounting an adapter parts for introducing a rinsing medium or mortar suspension and a boring drive.

FIG. 5 shows a simplified form of the inventive boring tube with the single boring bar 19 and the auger blade 20. Practically, the boring bar can be extended with the use of couplings shown in FIG. 4, and the boring bars 19 can be used as extension pieces with the auger blade extending over their whole length. As an example, FIG. 5 shows an anchor plate 30 and a nut 31 screwed on the boring bar 19 at the end facing away from the boring crown 2. With the use of the boring bar 19 as an injection boring anchor, they are used for clamping the boring bar 19 in the region of the bore hole opening relative to the surrounding rock walls. In a mounted condition, such a boring tube is inserted in a bore hole and bonded in a mortar layer which provides a fixed connection between the boring tube on the one hand and the surrounding walls of the bore hole on the other hand. The anchor plate 30 in the region of the bore hole opening forms an abutment and is supported on the wall of the corresponding space.

For placing the injection boring anchor equipped in this manner, which is for example designed for cohesive ground, it is first used as a boring bar as well known, and air as rinsing medium is supplied to the central longitudinal opening 10. The rinsing medium exits during the boring advance through the opening 21 on the one hand, takes the ground particles released by the boring crown 2 and then flows around the boring crown 2 and out of the outer side of the cylinder 12.

A part of the rinsing air flows to the contrary through the openings 11 into the ring chamber 15 and develops, after leaving the ring chamber, a suction at the point 26 to support the further transportation in direction toward the bore hole opening. Simultaneously, a stabilizing action is applied to the bore hole wall by the cylinder 12 which at the outer side substantially corresponds to the dimensions of the bore hole wall.

A auger blade 20 extends approximately directly to the associated end of the cylinder 12 and applies during the boring progress a transporting action to the material flowing between the inner side of the bore hole wall and the outer side of the boring bar 19 in direction to the bore hole opening. Simultaneously due to the auger blade the bore hole walls are smoothed and made comparable and a further action of the auger blade resides in an accurately centering guidance of the boring bars inside the bore hole.

The cross-section of the auger blade 20 also takes part in the transportation of the released ground material. In the region of a coupling piece 24, due to the corresponding length measurement of the portion of the tubular cylinder 26 extending outwardly beyond the tubular cylinder 27, care should be taken that the open ends of the auger blades 20 of two boring bars arranged on one another are located exactly opposite to one another. When needed, also the tubular cylinder 27 can be provided with a corresponding auger blade element, so that due to the length measurement of the above mentioned portion a continuous course of the auger blade 20 over the whole length of the injection boring anchor composed of several boring bars is provided.

After the boring, the longitudinal opening 10 is used in a known manner for introducing a mortar suspension which continuously fills the bore hole, starting from the region of the bore hole bottom and continuing in direction to the bore hole opening. In the filled condition the boring bores due to the central guidance with the auger blade are provided over the whole bore hole length with a uniform mortar covering which also produces the covering inside it due to the hollow cross-section of the auger blade. This means that over the whole length of the injection boring anchor a uniform and a reliably acting corrosion protection is provided. It should be mentioned that in correspondence with the radius 23, the auger blade 20 is measured so that with the central guidance of the injection boring rod an all-side average covering with mortar or a similar medium, such as for example a synthetic resin is provided with a layer thickness of at least 10 mm–15 mm.

The utilization of the inventive anchoring bar is illustrated for the injection boring anchor composed of a boring head 1 and various boring rods connected with one another by the connecting piece. However, the possibilities of use are not limited to the example presented above. For example, there is a possibility to use also screwable extrusion valves between two bore rods, as disclosed for example in the not published patent application P 41 28 154.3 of the applicant. Its characteristic feature is a tubular cylinders of the type identified with reference numeral 27 in FIG. 4 which are screwed at a distance from one another on the tubular cylinder 26 of a smaller diameter and extend so that a valve part extends therebetween and is composed of an elastic sleeve body. Similarly to the coupling part 24, the end portion of the inner tubular cylinder 26 extends over the outer tubular cylinder 27 and is formed for screwing in the associated boring bar ends. Due to the use of such an extrusion valve between two boring bar ends, the total radial dimensions are not changed.

It will be understood that each of the elements described above, or two or more together, may also find a useful application in other types of constructions differing from the types described above.

While the invention has been illustrated and described as embodied in a boring tube, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A boring tube useable as an injection anchor, comprising at least one tubular base body having a throughgoing longitudinal passage and an outer side; a boring head releasably connected with said base body; an auger blade arranged on said outer side of said base body and uninterruptedly extending over its whole length, said auger blade having a pitch of 1 m–3 m and a radial width which starting from the outer side of said base body is at least 10 mm, said body being provided on said outer side with a radially outwardly profile which is throughgoing along a length of said base body, said boring head having an axially short, plate-shaped boring crown provided with at least one rinsing opening communicating with said longitudinal passage of said base body; a coupling body arranged on said boring crown concentrically relative to a longitudinal axis of said boring crown and having a threaded portion at an end which is opposite to said boring crown for screwing with said base body, said auger blade having an outer diameter which at most is equal to 1.05 times an outer diameter of said boring crown.

2. A boring tube as defined in claim 1, wherein said base body and said auger blade together form a one-piece element composed of a cold deformed steel.

3. A boring tube as defined in claim 1, wherein said auger blade in a cross-section of said body is arranged tangentially to a contour of said base body.

4. A boring tube as defined in claim 1, wherein said auger blade in a cross-section of said body has a solid profile.

5. A boring tube as defined in claim 1, wherein said auger blade in a cross-section of said body has auger blade surfaces which are all arranged tangentially to a contour of said base body, and a cross-section of said auger blade narrows in a radially outer direction.

6. A boring tube useable as an injection anchor, comprising at least one tubular base body having a throughgoing longitudinal passage and an outer side; a boring head releasably connected with said base body; an auger blade arranged on said outer side of said base body and extending over its whole length, said auger blade having a pitch of 1 m–3 m and a radial width which starting from the outer side of said base body is at least 10 mm, said body being provided on said outer side with a throughgoing profile, said boring head having an axially short, plate-shaped boring crown provided with at least one rinsing opening communicating with said longitudinal passage of said base body; a coupling body arranged on said boring crown concentrically relative to a longitudinal axis of said boring crown and having a threaded portion at an end which is opposite to said boring crown for screwing with said base body, said auger blade having an outer diameter which at most is equal to 1.05 times an outer diameter of said boring crown, said throughgoing profile of said base body being formed as a thread.

7. A boring tube useable as an injection anchor, comprising at least one tubular base body having a throughgoing longitudinal passage and an outer side; a boring head releasably connected with said base body; an auger blade arranged on said outer side of said base body and extending over its whole length, said auger blade having a pitch of 1 m–3 m and a radial width which starting from the outer side of said base body is at least 10 mm, said body being provided on said outer side with a throughgoing profile, said boring head having an axially short, plate-shaped boring crown provided with at least one rinsing opening communicating with said longitudinal passage of said base body; a coupling body arranged on said boring crown concentrically relative to a longitudinal axis of said boring crown and having a threaded portion at an end which is opposite to said boring crown for screwing with said base body, said auger blade having an outer diameter which at most is equal to 1.05 times an outer diameter of said boring crown, said body being provided over its whole length with a throughgoing inner thread.

8. A boring tube useable as an injection anchor, comprising at least one tubular base body having a throughgoing longitudinal passage and an outer side; a boring head releasably connected with said base body; an auger blade arranged on said outer side of said base body and extending over its whole length, said auger blade having a pitch of 1 m–3 m and a radial width which starting from the outer side of said base body is at least 10 mm, said body being provided on said outer side with a throughgoing profile, said boring head having an axially short, plate-shaped boring crown provided with at least one rinsing opening communicating with said longitudinal passage of said base body; a coupling body arranged on said boring crown concentrically relative to a longitudinal axis of said boring crown and having a threaded portion at an end which is opposite to said boring crown for screwing with said base body, said auger blade having an outer diameter which at most is equal to 1.05 times an outer diameter of said boring crown; a second such base body; and a coupling piece for connecting said base bodies with one another, said coupling piece including a first tubular cylinder formed for screwing into said base bodies and a second tubular cylinder arranged in said first tubular cylinder so that said tubular extends outwardly beyond both ends of said first tubular cylinder, said second tubular cylinder and said base bodies having at least an outer thread, said first tubular cylinder having a portion extending beyond said second tubular cylinder and dimensioned so that in an assembled condition of two of said base bodies associated ends of said auger blades are in alignment with one another.

9. A boring tube as defined in claim 8, wherein said second tubular cylinder is arranged centrally on said first tubular cylinder.

10. A boring tube as defined in claim 8, wherein said second tubular cylinder has a auger blade which corresponds to said auger blade of said base body so that in an assembled condition said auger blades of one of said base bodies, of said second tubular cylinder and of the other of said base bodies have a substantially continuous course.

11. A boring tube as defined in claim 8; and further comprising webs extending over said ring space and connecting said supporting cylinder with said coupling body.

12. A boring tube as defined in claim 8, wherein said threaded portion of said coupling body is formed for screwing in said base body, said coupling being composed of two tubular cylinders which are screwed in one another, said tubular cylinders including an outer tubular cylinder and an inner tubular cylinder which extends outwardly beyond said outer tubular cylinder and has a threaded portion for screwing in said base body, said inner tubular cylinder having radial dimensions corresponding to radial dimensions of said first tubular cylinder of said coupling piece, said outer tubular cylinder having radial dimensions corresponding to radial dimensions of said second tubular cylinder of said coupling piece, said outer tubular cylinder and said second tubular cylinder having radial dimensions corresponding to radial dimensions of said body, said supporting cylinder extending over an axial length substantially corresponding to an axial length of said outer tubular cylinder.

13. A boring tube as defined in claim 8, wherein said radially extending openings which open into said annular space are arranged in a region of said coupling body which is closed to said boring crown.

14. A boring tube useable as an injection anchor, comprising at least one tubular base body having a throughgoing longitudinal passage and an outer side; a boring head releasably connected with said base body; an auger blade arranged on said outer side of said base body and extending over its whole length, said auger blade having a pitch of 1 m–3 m and a radial width which starting from the outer side of said base body is at least 10 mm, said body being provided on said outer side with a throughgoing profile, said boring head having an axially short, plate-shaped boring crown provided with at least one rinsing opening communicating with said longitudinal passage of said base body; a coupling body arranged on said boring crown concentrically relative to a longitudinal axis of said boring crown and having a threaded portion at an end which is opposite to said boring crown for screwing with said base body, said auger blade having an outer diameter which at most is equal to 1.05 times an outer diameter of said boring crown, said coupling body being provided with a throughgoing opening which forms a continuation of said longitudinal passage of said base body, said boring crown having a greater diameter than said coupling body; and further comprising a supporting cylinder arranged on said boring crown and surrounding said coupling body with a ring spaced therebetween, said supporting cylinder having an end which faces away of said boring crown and is open, said opening of said coupling body communicating with said ring space through radial throughgoing openings, said supporting cylinder having an outer diameter which at most corresponds to an outer diameter of said boring crown, said supporting cylinder having a smooth wall and being composed of metal.

* * * * *